US012584228B2

(12) United States Patent
Langer et al.

(10) Patent No.: US 12,584,228 B2
(45) Date of Patent: Mar. 24, 2026

(54) PREPARATION FOR PRE-TREATING SURFACES BY CHEMICALLY CONVERTING OXIDE LAYERS OF TITANIUM OR TITANIUM ALLOYS

(71) Applicant: Airbus Operations GmbH, Hamburg (DE)

(72) Inventors: Benedikt Langer, Hamburg (DE); Tobias Mertens, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 0 days.

(21) Appl. No.: 18/772,898

(22) Filed: Jul. 15, 2024

(65) Prior Publication Data

US 2024/0368770 A1 Nov. 7, 2024

Related U.S. Application Data

(63) Continuation of application No. 17/254,901, filed as application No. PCT/EP2019/067602 on Jul. 1, 2019, now abandoned.

(30) Foreign Application Priority Data

Jun. 29, 2018 (DE) ..... 102018005156.1

(51) Int. Cl.
*C23G 1/20* (2006.01)

(52) U.S. Cl.
CPC ..... *C23G 1/205* (2013.01)

(58) Field of Classification Search
CPC ..... C23G 1/205; C23C 22/64
See application file for complete search history.

(56) References Cited

U.S. PATENT DOCUMENTS

| | | | | |
|---|---|---|---|---|
| 3,907,609 | A * | 9/1975 | Coggins | C23C 22/64 134/40 |
| 4,334,936 | A | 6/1982 | Goolkate | |
| 9,127,194 | B2 | 9/2015 | Reyes | |
| 10,059,089 | B2 * | 8/2018 | Jürgens | B32B 27/06 |
| 10,221,347 | B2 | 3/2019 | Smith et al. | |
| 2008/0221006 | A1 | 9/2008 | Heisig et al. | |
| 2010/0175209 | A1 * | 7/2010 | Gormley | C11D 17/049 427/372.2 |
| 2014/0073554 | A1 | 3/2014 | Van Der Eerden et al. | |
| 2014/0116472 | A1 | 5/2014 | Dahlquist et al. | |
| 2014/0116473 | A1 | 5/2014 | Dahlquist et al. | |
| 2014/0151235 | A1 * | 6/2014 | Mertens | C25D 11/26 205/322 |
| 2015/0005216 | A1 | 1/2015 | De Wolf et al. | |
| 2018/0057773 | A1 | 3/2018 | McMillen et al. | |
| 2021/0262097 | A1 | 8/2021 | Langer et al. | |

FOREIGN PATENT DOCUMENTS

| | | | | |
|---|---|---|---|---|
| AT | 177630 | B | 2/1954 | |
| DE | 3427543 | A1 | 7/1985 | |
| DE | 3427543 | C2 * | 3/1989 | C23G 1/205 |
| DE | 102011106764 | B4 | 3/2013 | |
| EP | 0034842 | B1 | 9/1981 | |
| EP | 3564350 | A1 | 11/2019 | |
| GB | 2150603 | A * | 7/1985 | C25D 11/26 |
| WO | 2016089394 | A1 | 6/2016 | |

OTHER PUBLICATIONS

DE-3427543-C2, Machine Translation. (Year: 2025).*

* cited by examiner

*Primary Examiner* — Duy Vu N Deo
*Assistant Examiner* — Christopher Remavege
(74) *Attorney, Agent, or Firm* — Greer Burns & Crain Ltd.

(57) ABSTRACT

A preparation and a process for the surface pretreatment of titanium or titanium alloys containing 200 to 400 g/l NaOH and 10 to 150 g/l MGDA in water, wherein the preparation has a pH of at least 12, and preferably 13, and wherein a content of further substances is less than 1 g/l.

10 Claims, No Drawings

PREPARATION FOR PRE-TREATING SURFACES BY CHEMICALLY CONVERTING OXIDE LAYERS OF TITANIUM OR TITANIUM ALLOYS

CROSS-REFERENCES TO RELATED APPLICATIONS

This application is a Divisional of U.S. patent application Ser. No. 17/254,901 filed on Dec. 22, 2020, which claims the benefit of the International Application No. PCT/EP2019/067602, filed on Jul. 1, 2019, and of the German patent application No. 102018005156.1 filed on Jun. 29, 2018, the entire disclosures of which are incorporated herein by way of reference.

FIELD OF THE INVENTION

The invention relates to a preparation for surface pretreatment by chemically converting oxide layers of titanium or titanium alloys, and to a process for the surface pretreatment of articles composed of titanium or titanium alloys comprising contacting the article composed of titanium or titanium alloys with such a preparation.

BACKGROUND OF THE INVENTION

The use of titanium in the aerospace industry has increased in the last 30 years, accounting for up to 15% of the structural weight in the most recent aircraft generations (e.g., Airbus 350 XWB, Boeing 787). The reasons for the increase could be attributable to the need to replace aluminum structures at connection points between composite materials and metal structures due to problems with galvanic corrosion. The corrosion resistance and the strength-to-weight ratio of titanium and its alloys make it interesting for new design concepts. Titanium materials exhibit problems with long-term stable adhesion. Rivet rashes on titanium rivet heads, discoloration at crack arrestors or delamination of fiber metal laminates are some examples of this problem.

Surface treatment is therefore the most important step for ensuring durable connections. To increase durability, treatments for the surface modification of titanium have been developed.

Mechanical surface treatments such as sandblasting are mainly used to produce a macroscopically rough surface and to remove residues.

Physical (e.g., plasma or laser) or wet-chemical treatments (e.g., etching or anodizing) are usually used to produce long-term stable adhesive bonds. Anodization processes are used in the aviation industry for the pretreatment of titanium. The most common method for obtaining porous oxide layers is chromic acid anodization (CAA) using small amounts of fluorides in the electrolyte. The nanostructures are produced by localized chemical dissolution (fluorine ions) with controlled field-assisted oxidation and dissolution reactions. CAA results in a high bond stability. Besides anodization in acidic electrolytes, alkaline electrolytes are also discussed as a pretreatment for the structural bonding of titanium. Using sodium hydroxide-based electrolytes, porous oxide layers could be created on titanium. Sodium hydroxide anodization can achieve good durability of adhesive bonds in the case of moisture and stress. DE 3427543 discloses the use of electrolytes with sodium hydroxide with complexing agents such as ethylenediaminetetraacetic acid (EDTA) in order to increase the dissolution rate. This NaTESi process can be used to achieve a highly porous oxide layer and good long-term stability.

DE102011106764B4 discloses an anodizing process based on sodium hydroxide, methylglycinediacetic acid and disodium tartrate dihydrate, and also pentasodium phosphate.

Sol-gel processes, the Rocatec process and Pyrosil treatment are also known.

There is no prior art process that can ensure long-term stable adhesion to titanium without using an energy source such as lasers or an electric field or chemical components which are not regulation-compliant over the long term.

Anodization processes are limited in terms of application. Due to physics (Faraday effect), they cannot be used in pipes, cavities or channels without additional effort. Shadow effects might lead to development of an inhomogeneous oxide layer as well. The anodization parameters frequently have to be adapted to each titanium alloy used.

Laser treatments can generate a nanostructured titanium surface which results in good long-term adhesion. However, since the laser is a line-of-sight method, perpendicular access to the surface has to be guaranteed. This is not possible without significant effort in the case of complex parts. A laser also involves a melting process of the surface which even for nanosecond-pulsed systems causes a heat-affected zone having different properties compared to the base material.

There is no prior art process that can ensure long-term stable adhesion to titanium without using an energy source such as lasers or an electric field or chemical components which are not regulation-compliant over the long term.

SUMMARY OF THE INVENTION

It has now been found, in a manner completely surprising to the person skilled in the art, that a preparation for the surface pretreatment of titanium or titanium alloys containing 200 to 400 g/l NaOH and 10 to 150 g/l MGDA in water, wherein the preparation has a pH of at least 12, preferably at least 13, remedies the disadvantages of the prior art. In the context of the present invention, surface pretreatment is understood to mean a chemical conversion of oxide layers of the titanium or titanium alloy. Based on atomic %, titanium alloys predominantly consist of titanium. The NaOH content advantageously does not exceed the value of 590 g/l. Using the preparation according to the invention makes it possible to convert the oxide layer present, which has formed naturally or can be produced artificially, into a nanostructured porous surface. Such nanostructured porous surfaces can also be referred to as a nanostructured network. These nanostructured porous surfaces can enable long-term stable adhesion of organic coatings on titanium substrates. In addition, the preparation according to the invention is free of buffers, such as citrate-citric acid buffer, does not contain any sulfate, and does not contain any enzymes, in particular any amylases or proteases. The surfactant content is very low and does not exceed the value of 5% by weight based on MGDA. The preparation according to the invention is additionally free of whiteners and silicates. The preparation according to the invention can be used to treat surfaces of titanium or titanium alloys electrolessly and/or at low temperature. MGDA is methylglycinediacetic acid, and this also means salts of this acid such as the trisodium salt. The acid has the structural formula $$(HOOC—CH_2—)_2N—CH(CH_3)—COOH.$$

It is a biodegradable water-softening additive for dishwashing detergents which was developed in order to avoid the less environmentally compatible use of phosphates or poorly degradable water softeners in machine dishwashing detergents.

Amounts indicated in this document are based on the trisodium salt of MGDA.

The invention also comprises a process for the surface pretreatment of articles composed of titanium or titanium alloys, comprising contacting the article composed of titanium or titanium alloys with a preparation containing 200 to 400 g/l NaOH and 10 to 150 g/l MGDA in water, wherein the content of further substances is less than 1 g/l and the pH of the preparation has a pH of at least 12, preferably at least 13, for 5 to 60 minutes at 20 to 80° C.

Contacting can in this case be immersion, spraying, coating. The process according to the invention makes it possible to produce nanostructures having dimensions of below 100 nm, and hence to produce a mechanical and chemical anchoring by means of an enlarged surface area, which improves the durability and adhesion properties of titanium or titanium alloys thus treated.

It is preferable here if in the preparation according to the invention the fluoride content is not detectable or is less than 0.001% by weight, based on the fluoride present in the preparation used. It is further preferable if the content of NaOH is 300 to 375 g/l, preferably 350 g/l, and the content of MGDA is 30 to 100 g/l, preferably 60 g/l. It is further preferable if the preparation according to the invention has a content of polymeric thickeners. It is preferable here if the thickeners used are xanthan gum or agar-agar and/or the thickener is present in concentrations of 2 to 40 g/l, preferably 10 to 15 g/l. It is further preferable if the content of further substances in the preparation according to the invention is less than 0.5 g/l, preferably 0.3 g/l. It is further preferable if the contacting is effected by immersion. It is further preferable if the contacting is effected for 10 to 30 minutes at 40 to 70° C. It is further preferable if the contacting is effected for 20 minutes at 60° C.

The process according to the invention particularly preferably comprises a pretreatment for ensuring the wettability of the titanium or titanium alloys, in particular, with surface-active substances. The process according to the invention further preferably comprises an aftertreatment for washing off the preparation according to the invention, in particular, by washing off with demineralized water.

A product according to the present invention is an article composed of titanium or titanium alloys obtainable by a process according to the invention or using a preparation according to the invention. It is preferable if the article according to the invention composed of titanium or titanium alloys having a porous layer at the surface, wherein the pores are predominantly open, have a number-average pore size of less than 100 nm, preferably 30 to 70 nm.

The invention further comprises an aircraft, in particular, an aircraft comprising an article according to the invention composed of titanium or titanium alloys.

The above-described aspects and further aspects, features and advantages of the invention can also be gathered from the examples of embodiments which are described below.

EXAMPLES

The examples show various treatments of various titanium alloys. The conditions are stated in each case. Prior to the treatment, the material samples are washed with isopropanol or with an alkaline degreasing agent (Metaclean T2001, experiments 7 and 8 only). After drying, the samples were treated with the aqueous solutions specified by immersion without movement or stirring. The solutions had a pH of approx. 14. After the treatment, the surface obtained was assessed visually. An iridescent surface indicates a surface modification with characteristic dimensions in the region of the wavelength of light (nanostructured surface).

| # | | NaOH [g/l] | MGDA [g/l] | T [° C.] | T [min] | Evaluation/observation |
|---|---|---|---|---|---|---|
| 1 | Ti6Al4V | 240 | 30 | 60 | 15 | ++ green/blue iridescent surface |
| 2 | Ti6Al4V | 240 | 60 | 60 | 15 | ++ iridescent surface |
| 3 | Ti6Al4V | 350 | 120 | 75 | 15 | ++ iridescent surface |
| 4 | Ti6Al4V | 350 | — | 65 | 15 | – surface not nanostructured |
| 5 | Ti6Al4V | 350 | 30 | 65 | 15 | ++ iridescent surface |
| 6 | Ti6Al4V | 450 | 30 | 65 | 15 | + yellowish iridescent surface with violet specks |
| 7 | Ti6Al4V | 200 | 30 | 65 | 15 | ++ green/blue iridescent surface |
| 8 | Cp—Ti | 200 | 30 | 65 | 15 | ++ violet/blue iridescent surface |
| 9 | Ti6Al4V | 350 | 60 | 60 | 15 | ++ iridescent surface |

A loss of mass was observed in experiment 5 only.

SEM images of the surface obtained in experiment 5 show a sponge-like surface structure with pore sizes of 30 to 100 nm. The pore walls are of an open and irregularly network-like configuration.

The roller peel test in accordance with DIN 2243-2 showed exceptional adhesion compared to untreated titanium sheet: at room temperature there was exclusively failure of the adhesive layer and not detachment of the bond, and at −55° C. there was 95% failure of the bond. (Surface pretreatment by alkaline cleaning followed by treatment with HNO3/HF mixture, then analogous to example 5, Ti peel plate: 300*210*0.4 mm, BR 127 primer (cytec), FM 94 adhesive (cytec); room temperature: 174.9 N (100% cohesive failure); −55° C.: 141.2 N (95% cohesive failure)).

It is noted that the embodiments described are merely illustrative and are not restrictive.

While the invention has been illustrated and described in detail in the examples and the preceding description, it is intended that such illustrations and descriptions be merely illustrative or exemplary and not restrictive, so that the invention is not limited by the embodiments disclosed. In the claims, the word "having" does not exclude other elements and the indefinite article "a" does not exclude a plurality.

The mere fact of mentioning certain features in various dependent claims does not restrict the subject matter of the invention. Combinations of these features can also be used to advantage.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A process for a surface pretreatment of articles composed of titanium or titanium alloys, comprising:

contacting the articles composed of titanium or titanium alloys with a preparation containing 200 to 400 g/l NaOH and 10 to 150 g/l MGDA in water, wherein a content of further substances in the preparation is less than 1 g/l, wherein a pH of the preparation is at least 12, and wherein the contacting is effected for 5 to 60 minutes at 20 to 80° C.

2. The process as claimed in claim 1, wherein the pH is at least 13.

3. The process as claimed in claim 1, wherein a fluoride content is less than 0.001% by weight, based on fluoride present in the preparation used.

4. The process as claimed in claim 1, wherein a content of NaOH is 300 to 375 g/l, and a content of MGDA is 30 to 100 g/l.

5. The process as claimed in claim 1, wherein the contacting is effected by immersion.

6. The process as claimed in claim 1, wherein the contacting is effected for 10 to 30 minutes at 40 to 70° C.

7. The process as claimed in claim 1, wherein the contacting is effected for 20 minutes at 60° C.

8. The process as claimed in claim 1, wherein the article has a porous layer at a surface thereof after the contacting step, wherein pores of the porous surface are predominantly open, and have a number-average pore size of less than 100 nm.

9. The process as claimed in claim 8, wherein the number-average pore size is 30 to 70 nm.

10. An article composed of titanium or titanium alloys treated using the method as claimed in claim 1.

* * * * *